United States Patent [19]

Tohma et al.

[11] Patent Number: 5,002,819

[45] Date of Patent: Mar. 26, 1991

[54] THERMAL TRANSFER MATERIAL

[75] Inventors: Koichi Tohma, Kawasaki; Naoki Kushida; Yasuyuki Tamura, both of Yokohama, all of Japan

[73] Assignee: Canon Kabushiki Kaisha, Tokyo, Japan

[21] Appl. No.: 162,574

[22] Filed: Mar. 1, 1988

[30] Foreign Application Priority Data

Mar. 2, 1987 [JP] Japan ..... 62-048586

[51] Int. Cl.[5] ..... B41M 5/26

[52] U.S. Cl. ..... 428/212; 428/195; 428/207; 428/423.1; 428/480; 428/484; 428/488.1; 428/488.4; 428/913; 428/914

[58] Field of Search ..... 428/195, 207, 211, 212, 428/484, 488.1, 488.4, 913, 914, 423.1, 480

[56] References Cited

U.S. PATENT DOCUMENTS 4,681,796 7/1987 Maehashi et al. ..... 428/488.1

FOREIGN PATENT DOCUMENTS 208385 1/1987 European Pat. Off. ..... 428/195

*Primary Examiner*—Pamela R. Schwartz

*Attorney, Agent, or Firm*—Fitzpatrick, Cella, Harper & Scinto

[57] ABSTRACT

A thermal transfer material suitable for two-color recording comprises a support and at least an adhesive layer, a first ink layer, and a second ink layer disposed in this order on the support. The adhesion strength $F_1$ between the support and the first ink layer and the adhesion strength $F_2$ between the first and second ink layers satisfy the relations of $F_1 > F_2$ at a higher temperature and $F_1 < F_2$ at a lower temperature. The adhesion strength $F_1$ is in the range of 1.0–10 g/cm in the case of $F_1 < F_2$ after heating. Sharp edge cutting of the heated portion and excellent transferability thereof are ensured by the definition of the adhesion strength $F_1$ after heating.

10 Claims, 4 Drawing Sheets

1 mm 1 mm

THERMAL TRANSFER MATERIAL

FIELD OF THE INVENTION AND RELATED ART

The present invention relates to a thermal transfer material for use in a recording method of transferring two-color images onto a recording medium such as plain paper.

The thermal or heat-sensitive transfer recording method has recently been widely used because it has general advantages of the thermal recording method such that the apparatus employed is light in weight, compact, free of noise, excellent in operability and adapted to easy maintenance, and also has other advantages such that it does not require a color-formation type converted paper but provides recorded images with excellent durability.

Further, there is also a commercial demand for a method of obtaining two-color images while retaining the advantages of the thermal transfer recording method as described above. Accordingly, there have been proposed several techniques for obtaining two-color images.

In order to obtain two-color images on plain paper by the thermal transfer recording method, Japanese Laid-Open Patent Application No. 148591/1981 discloses a two-color type thermal transfer recording element (transfer material) comprising a substrate and two heat-fusible ink layers including a high-melting point ink layer A and a low-melting point ink layer B containing mutually different colorants disposed in this order on the substrate. When a low thermal input energy is applied to the element, only the low-melting point layer B is transferred onto plain paper. On the other hand, when a high thermal input energy is applied to the element, both the heat-fusible ink layers A and B are transferred onto the plain paper. As a result, two-color images can be obtained.

Further, Japanese Laid-Open Patent Application No. 64389/1984 discloses a two-color thermal transfer ink sheet which comprises, on a substrate, an ink layer comprising an ink which melt-exudes at a lower temperature and another ink which is melt-peeled at a higher temperature than the melt-exudation temperature.

In the methods using the above-mentioned thermal transfer materials, two-color recording is effected by changing the energy applied to a thermal head at two levels so as to change the temperature of the ink layers. However, when a high energy is supplied to the ink layers to provide a high temperature, a lower temperature portion is formed at the periphery of a higher temperature portion due to heat diffusion, so that a bordering of a lower temperature color is formed around the higher temperature printed image. Further, when a high energy is supplied to a thermal head, it requires a relatively long time until the thermal head is cooled so that a higher-temperature printed image is liable to be accompanied with a trailing of a lower-temperature color. Further, in any of the above methods, there is a constraint that a relatively low melting material is required for providing an ink to be transferred at a lower temperature, whereby they give rise to problems such as ground soilind and low storability of the thermal transfer material.

As a technique for dissolving above-mentioned problems, our research group has proposed a recording method as disclosed in Japanese Laid-Open Patent Application No. 137789/1986 (U.S. Pat. No. 4,880,324). In this recording method, there is employed a thermal transfer material comprising a support and at least a first ink layer and a second ink layer disposed in this order on the support, and after heat is applied to the thermal transfer material, a length of time from the heat application until the separation between the transfer material and a recording medium is so controlled that the second ink layer is selectively, or both the first and second ink layers are, transferred to the recording medium.

Our research group has further proposed, as a thermal transfer material for use in such recording method, one as disclosed in Japanese Laid-Open Patent Application No. 295075/1986 and one as disclosed in Japanese Laid-Open Patent Application No. 295079/1986. Japanese Laid-Open Patent Application No. 295075/1986 discloses a thermal transfer material wherein at least one of a first ink layer and a second ink layer contains a silicone oil or a fluorine-containing surfactant so as to promote separation between the first and second ink layers. Japanese Laid-Open Patent Application No. 295079/1986 discloses a thermal transfer material wherein a fine powder layer not meltable under application of a heat energy for recording is disposed between a first ink layer and a second ink layer so as to easily cause separation therebetween.

The above-mentioned recording method disclosed in Japanese Laid-Open Pat. No. 137789/1986 (U.S. Pat. Ser. No. 4,880,324), has solved the problems of bordering, trailing, etc., in the prior art. In this new two-color recording method, however, a further improvement in transferred image quality is still desired.

In order to obviate a problem that the first ink is mixed into an image of the second ink when the second ink layer is selectively transferred in the above recording method, our research group has also proposed to separate the thermal transfer material from a recording medium under the action of a peeling force of not less than 20 g-f (gram-force) and less than 200 g-f in a direction perpendicular to and leaving from the surface of the recording medium toward the thermal transfer material (U.S. Pat. Application Ser. No. 58,852).

The quality of a recorded image is also improved by promoting sharp edge-cutting of a transferred image. It is, however, not always easy to effect such sharp edge-cutting in a transfer operation because it is influenced by various actual recording conditions such as a heat-application condition and a peeling condition among others.

Incidentally, as a technique for improving the edge-cutting of a transferred image obtained in the above-mentioned recording method disclosed in Japanese Laid-Open Patent Application No. 137789/1986 (U.S. Pat. Application Ser. No. 4,980,324), our research group has proposed a thermal transfer material wherein the total ink layers on a support have a tensile strength in the range of 8–20 kg/cm$^2$, as disclosed in Japanese Patent Application No. 226823/ 1986 (U.S. Pat. Application Ser. No. 4,960,632).

In order to effect sharp edge-cutting and to prevent a first ink from mixing into the image of a second ink when the second ink layer is selectively transferred in the above-mentioned recording method, our research group has further proposed a thermal transfer material wherein the first ink layer comprises a binder having a glass transition temperature (Tg) of 0° C. or below and 25 to 85 wt. % of a pigment (U.S. Pat, Application Ser. No. 4,880,686).

However, there has recently been a commercial demand for a transferred image, having a further high definition or resolution, and in order to meet such demand, a thermal head of high definition having a large number of heating element dots has also been developed. In a case where such thermal head of high definition is used, it is preferred to use a thermal transfer material adapted to a high definition recording. If a conventional thermal transfer material is subjected to a recording using the above-mentioned thermal head of high definition, an irregular transfer occurs at the periphery of a heat-applied portion and the edge portion of a printed image becomes uneven or irregular in some cases. Therefore, there has strongly been desired a thermal transfer material capable of providing a clear image even in combination with a thermal head of high definition.

SUMMARY OF THE INVENTION

A principal object of the present invention is to provide a thermal transfer material by which two-color recorded images with respectively clear color tones are given on plain paper through a simple process, by solving the above-mentioned problems involved in the conventional two-color recording method.

Another object of the present invention is to provide a thermal transfer material capable of providing a clear image even in combination with a heat-application means of high definition.

According to the present invention, there is provided a thermal transfer material comprising: a support and at least an adhesive layer, a first ink layer and a second ink layer disposed in this order on the support, wherein the adhesion strength $F_1$ between the support and the first ink layer and the adhesion strength $F_2$ between the first and second ink layers satisfy the relations of $F_1 > F_2$ at a higher temperature and $F_1 < F_2$ at a lower temperature; the adhesion strength $F_1$ being in the range of 1.0 g/cm − 10 g/cm when the relation of $F_1 < F_2$ is satisfied after heating.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DETAILED DESCRIPTION OF THE INVENTION

Figure 1:
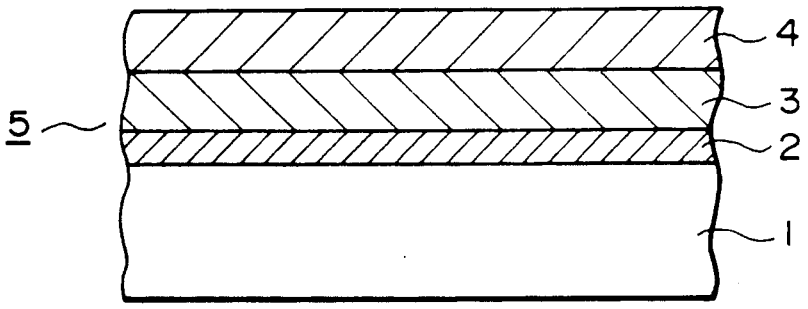
FIGS. 1 and 2 are respectively a schematic sectional view across the thickness of an embodiment of the thermal transfer material according to the present invention.

Referring to FIG. 1, a thermal transfer material 5 according to the present invention comprises a support 1, and a first adhesive layer 2, a first ink layer 3 and a second ink layer 4 disposed in this order on the support.

In the thermal transfer material of the present invention, it is essential that the adhesion (strength) $F_2$ between the first ink layer 3 and the second ink layer 4 and the adhesion (strength) $F_1$ between the first ink layer 3 and the support 1 satisfy the relations of $F_1 > F_2$ at a higher temperature and $F_1 < F_2$ at a lower temperature. When the transfer material of the present invention is supplied with heat, the separation between the first ink layer 3 and the second ink layer 4 is more readily caused than that between the first ink layer 3 and the support 1 immediately after the heating. On the other hand, the separation between the first ink layer 3 and the support 1 becomes relatively easier after a considerable time has passed from the heating until the separation of the support 1 from a recording medium, i.e., at the time when the transfer material 5 is cooled after the transfer material and the recording medium has been superposed, heated and retained for a substantial time after heating and before peeling.

The above-mentioned characteristics of the respective layers will be further explained with reference to FIG. 3.

Incidentally, the relative adhesion between the second and first ink layers and that between the first ink layer and the support are evaluated according to such a standard that the latter adhesion is larger if the second ink layer is substantially selectively transferred, and that the former is larger if substantially both the ink layers are transferred, respectively, when transfer recording is effected on a recording medium. Such evaluation of the adhesions is not affected by the form of separation between ink layers (e.g., whether or not the separation between the second and first ink layers has occurred strictly at the boundary between these layers, etc.).

The adhesion ($F_2$) between the first ink layer 3 and the second ink layer 4, and the adhesion ($F_1$) between the first ink layer 3 and the support 1, change on heating and cooling. In the present invention, the first adhesive layer 2 is disposed between the first ink layer 3 and the support 1 in order to control the adhesion $F_1$ between these layers. The first adhesive layer 2 may preferably be one causing an irreversible decrease in the adhesion $F_1$ through heating.

In the present invention, it is required that the adhesion ($F_2$) between the first ink layer 3 and the second ink layer 4, and the adhesion ($F_1$) between the first ink layer 3 and the support 1, respectively have a strength above a certain level before heating. If such initial adhesion is too small, there may be posed a problem, such as a decrease in storability or ink dropout of a thermal transfer material.

Figure 3:
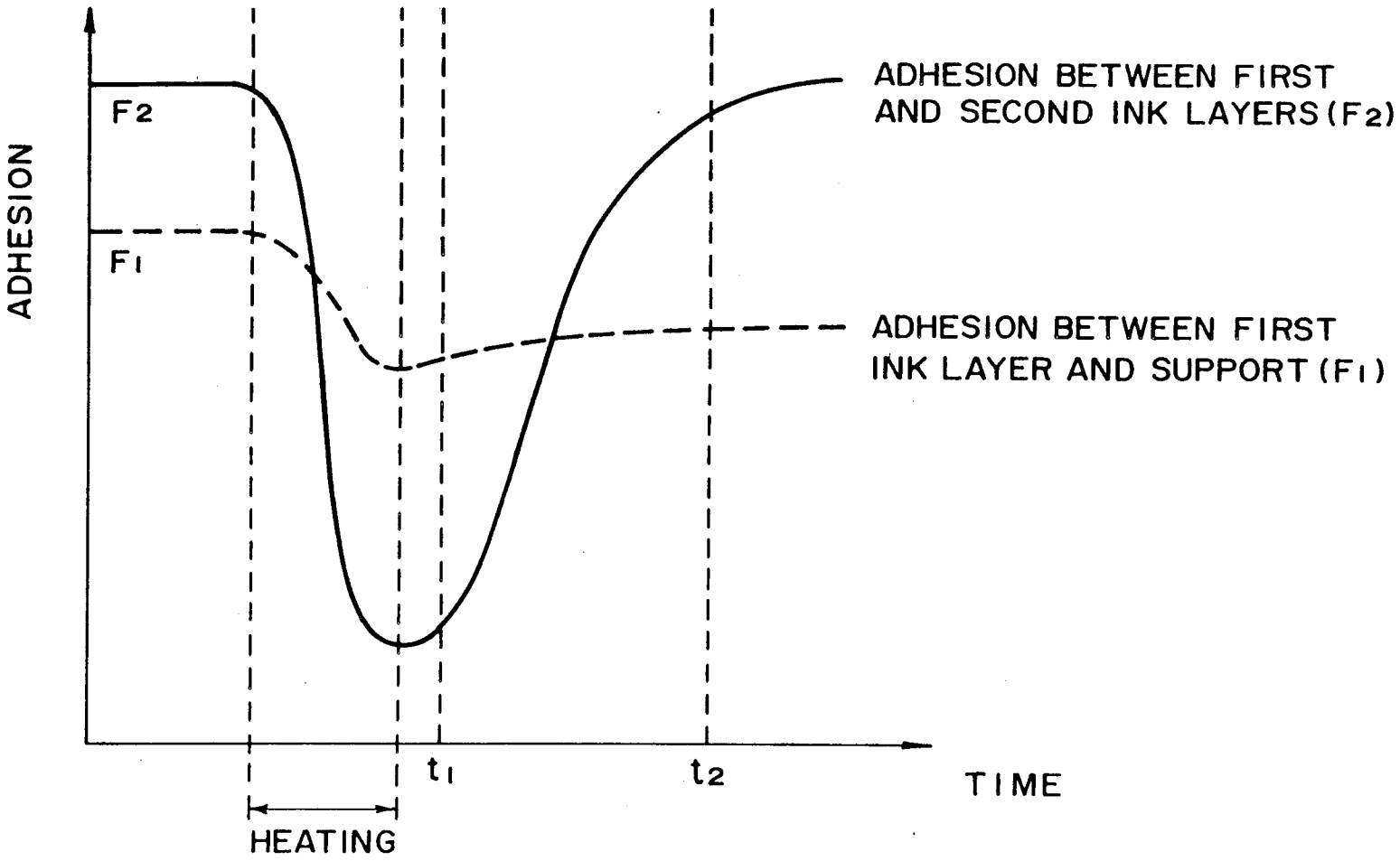
FIG. 3 is a graph showing a variation in adhesion strength between respective layers with the elapse of time.

In the embodiment shown in FIG. 3, the adhesion $F_2$ between the first ink layer 3 and the second ink layer 4 decreases more sharply than the adhesion $F_1$ between the first ink layer 3 and the support 1 on temperature increase due to heating by a thermal head. As a result, the adhesion $F_2$ between the first ink layer 3 and the second ink layer 4 is weaker than the adhesion $F_1$ between the first ink layer 3 and the support 1, at a time immediately after heating (i.e., before the temperature being lowered). Accordingly, if the transfer material is peeled from a recording medium such as paper immediately after the transfer material is heated while the second ink layer 4 thereof being in contact with the recording medium, i.e., at a time $t_1$ in FIG. 3, only the second ink layer 4 is transferred to the recording medium.

In contrast, if the temperature of the ink layer has been lowered when a little time has passed after heating, the adhesion $F_2$ is recovered to be essentially the same as that before heating. However, since the adhesion $F_1$ between the first ink layer 3 and the support 1 is irreversibly decreased through heating because of the adhesive layer 2 in this embodiment, the adhesion $F_1$ is not recovered to the state before heating. As a result, the adhesion $F_1$ between the first ink layer 3 and the support 1 is weaker than the adhesion $F_2$ between the first and second ink layers. Therefore, if the transfer material is peeled from the recording medium at this time, i.e., at a time $t_2$ in FIG. 3, the first ink layer 3 is transferred together with the second ink layer 4 to the recording medium.

Accordingly, if the first ink layer 3 and the second ink layer 4 are composed to have different color tones from each other in the thermal transfer material, two-color recording can be effected. When the color of the first ink layer 3 and the second ink layer 4 are desired to be obtained substantially as they are, it is preferred to dispose a first ink layer 3 of a dark color such as black and a second ink layer 4 of a brighter color than that of the first ink layer such as red. Further, the first and second ink layers can be made in the same hue but different in density from each other, whereby two-color images with dense and pale portions can be obtained in the same manner as described above. Further, the first ink layer can function as a correcting ink layer by incorporating, e.g., a white pigment having a strong hiding power therein.

As described above, the adhesion ($F_2$) between the first ink layer 3 and the second ink layer 4 may recover its initial state with the elapse of time after heating. On the other hand, in order to effect a recording of high definition, it is preferred that the adhesion $F_1$ between the first ink layer 3 and the support 1 is clearly weaker than the adhesion $F_2$ between the first and second ink layers at the time $t_2$ in FIG. 3. More specifically, in order to effect a recording of high definition, it is preferred that the adhesion $F_1$ is 1.0 g/cm -10 g/cm, more preferably 3 g/cm -8 g/cm when a prescribed time has passed from the heat application, i.e., at a time at which both the first and second ink layers are transferred to a recording medium.

In this case, if the adhesion $F_1$ is smaller than 1.0 g/cm, edge-cutting of the transferred image deteriorates whereby a clear image cannot be obtained. On the other hand, the adhesion $F_1$ is larger than 10 g/cm, the transferability of the first ink layer deteriorates.

More specifically, the above-mentioned adhesion $F_1$ after heating may be measured in the following manner.

(First measurement method)

An adhesive layer 2, a first ink layer 3 and a second ink layer 4 are successively formed on a support 1 of a polyethylene terephthalate (PET) film respectively in coating amounts of 0.5 g/m$^2$, 2.0 g/m$^2$ and 2.0 g/m$^2$, thereby to prepare a thermal transfer material 5. Then, the thermal transfer material 5 is superposed on a recording medium (thermal transfer paper TC-80, mfd. by Honshu Seishi K.K.) so that the second ink layer 4 of the transfer material 5 contacts the recording medium, and heat is applied in a solid print pattern to the transfer material 5 from its support 1 side by means of a thermal head at an energy of 13 mJ/dot under a pressing force of 600 g/cm. After the heat application, the transfer material 5 and the recording medium are, as they are without peeling, loaded on a tensile strength tester (Tensilon RTM-100, Toyo Boldwin K.K.). By using this tester, the PET film 1 and the recording medium are peeled from each other at a peeling angle of 180 degrees at a peeling speed of 300 mm/min, at room temperature (25° C.) so that the first ink layer is substantially transferred to the recording medium. A force required for such peeling is measured and converted to the strength thereof per a bonded width of 1 cm.

More specifically, the maximum strength (Fmax) and the minimum strength (Fmin) of such force during the peeling are measured and the adhesion strength $F_1$ is determined by the following formula:

$$F_1 = \frac{1}{2} \times (Fmax + Fmin)$$

Incidentally, in the above measurement, the heat is applied to the thermal transfer material so that the entire surface of the ink layer thereof is bonded to the recording medium. Further, the above-mentioned peeling is effected from the end of the ink layer bonded to the recording medium so that the maximum strength Fmax may be determined without consideration of the cutting of the ink layer (Second measurement method)

According to the above-mentioned first measurement method, the adhesion between the first ink layer and the support before heating cannot be measured. However, according to the following second measurement method, this adhesion between the first ink layer and the support may be measured.

Thus, only an adhesive layer 2 is formed on a 4.5 μm-thick PET film in a coating amount of 5 g/m$^2$, and then an adhesive tape (Mytack Laminate Label ML-211, mfd. by Nichiban K.K.) is caused to closely contact the coating surface. The resultant laminate is cut into a 8 mm-wide tape thereby to prepare a sample, which is then loaded on the above-mentioned tensile strength tester. By using this tester, the adhesive layer 2 is peeled from the support at a peeling angle of 135 degrees, at a peeling speed of 500 mm/min and at an environmental temperature of 25° C. A force required for such peeling is measured and converted to the strength thereof per a bonded width of 1 cm. Thus, the adhesion of the adhesive layer before heating may be measured.

Further, the above-mentioned 8 mm-wide sample is heated up to 100° C. and thereafter the adhesion may be measured according to the second measurement method. Thus, the adhesion after heating may also be measured according to the second measurement method.

As described above, according to the second measurement method, there is required a sample wherein only an adhesive layer 2 is applied onto a support 1. However, according to the first measurement method, the adhesion between the support 1 and the first ink layer 3 may be measured by using a sample in the form of a thermal transfer material as it is.

In the thermal transfer material according to the present invention, the adhesion ($F_1$) between the support 1 and the first ink layer 3 after heating, measured according to the first measurement method is 1.0–10 g/cm. On the other hand, when the adhesion $F_1$ in a sample comprising a combination of a support and an adhesive layer, which are the same as those of the thermal transfer material of the present invention, is measured according to the second measurement method, the adhesion after heating is 5.0–30 g/cm. Further, the adhesion $F_1$ before heating, when measured according to the second measurement method, is 80 g/cm or larger. Therefore, it is found that the adhesion $F_1$ irreversibly decreases through heating.

In a preferred embodiment of the thermal transfer material according to the present invention, an adhesive layer 2 is disposed between a support 1 and a first ink layer 3, and the adhesion $F_1$ after heating, as compared with that before heating, does not recover the initial strength but irreversibly decreases to 1.0–10 g/cm. In this case, a heat-applied portion and a non-heat-applied portion of the adhesive layer 2 show clearly different behaviors whereby there is provided a transferred image of high definition excellent in edge-cutting and transferability, even when a thermal head having a heating element density of 160 dots/inch or 240 dots/inch is used.

In order to irreversibly change the adhesion $F_1$ through heating as described above, in the present invention, an adhesive layer 2 may preferably comprise wax component A and an adhesive component B. Further, the wax component A may preferably be in the form of particulates. It is preferred that these components A and B are mixed so that the initial adhesion $F_1$ before heating becomes above a certain value and a problem such as a decrease in storability and ink dropout is not caused. More specifically, the weight proportion of the wax component A to the adhesive component B may preferably be $0.5 \leqq A/B \leqq 20$ as described hereinafter.

In a case where the first adhesive layer 2 is composed in this manner, in a state thereof before heat-application, it is presumed that the adhesive component B is present as a binder around the particulate wax component A, and that the adhesive layer 2 bonds the first ink layer 3 to the support 1 so as not to cause an ink dropout, etc.

The particulate wax component in the adhesive layer 2 is softened when once supplied with heat, and thereafter is formed into a film as it is cooled. As a result, the adhesive layer 2 is controlled by the film-formed wax component to decrease its flexibility, whereby the releasability thereof becomes stronger than the adhesion of the adhesive component. In the thermal transfer material of the present invention, the adhesion $F_1$ is so controlled as to decrease to 1.0–10.0 g/cm. In consideration of the decrease in adhesion after heat-application, the mixing proportion of the wax component A to the adhesive component B in the adhesive layer may preferably be $0.5 \leqq A/B \leqq 20$ as described above, more preferably $1 \leqq A/B \leqq 9$, particularly preferably $1.5 \leqq A/B \leqq 6$.

In a case where the adhesive layer 2 comprises the wax component A and the adhesive component B in this manner, the adhesion thereof may irreversibly change. More specifically, the adhesion between the support 1 and the first ink layer 3 decreases from an initial adhesion before heat-application to an adhesion after the heat-application, and does not completely recover to the initial state.

In order to enhance the above-mentioned effect, the particulate wax component A may preferably comprise a wax having a softening temperature of 60°–150° C. Further, the particulate wax component A may preferably have a particle size smaller than the thickness of the adhesive layer 2. More specifically, the particulate wax component A may preferably have an average particle size of about 0.05–5 μm.

The wax component may be selected, as a single species or a combination of two or more species as desired, from the following known materials: natural waxes such as whale wax, beeswax, lanolin, carnauba wax, candelilla wax, montan wax and ceresin wax; petroleum waxes such as paraffin wax and microcrystalline wax; synthetic waxes such as ester wax, low-molecular weight polyethylene, Fischer-Tropsch wax and the like; higher fatty acids such as lauric acid, myristic acid, palmitic acid, stearic acid, and behenic acid; higher alcohols such as stearyl alcohol and behenyl alcohol; esters such as fatty acid esters of sucrose and fatty acid esters of sorbitane; amides such as oleic amide; etc.

If a wax having a softening temperature of below 60° C. is used, the particulate characteristics thereof may be lost gradually in a storage state, or may cause an offset of the ink layer in storage at a high temperature (at about 60° C.). On the other hand, if a wax having a softening temperature of above 150° C. is used, the quantity of heat applied in a recording may be insufficient and cannot cause a sufficiently melted state whereby it is difficult to cause an intended irreversible change.

The wax component particularly preferably used in the present invention is a polyethylene wax having a softening temperature of 80° C.–150° C. and a number-average molecular weight of 1,000–6,000, more preferably a polyethylene wax having a softening temperature of 90° C.–140° C. and a number-average molecular weight of 2,000–5,000, further preferably an oxidized polyethylene wax having a softening temperature of 90° C.–140° C. and a number-average molecular weight of 2,000–5,000.

The "softening temperature" used in the present invention is a flow initiation temperature as obtained from an apparent viscosity-temperature curve of a sample based on a measurement by a flow tester (Model: CFT500, available from Shimazu Seisakusho K.K.) under the conditions of a load of 10 kg, and a temperature increasing rate of 2° C./min Further, the number-average molecular weight Mn of polyethylene wax is measured in the following manner.

[Molecular Weight Measurement]

The VPO method (Vapor Pressure Osmometry Method) is used. A sample of polyethylene wax is dissolved in a solvent such as benzene at various concentrations (C) in the range of 0.2 to 1.0 g/100 ml to prepare several solutions. The osmotic pressure ($\pi/C$) of each solution is measured and plotted versus the concentration to prepare a concentration (C)-osmotic pressure ($\pi/C$) curve, which is extrapolated to obtain the osmotic pressure at the infinite dilution $(\pi/C)_0$. From the equation of $(\pi/C)_0 = RT/Mn$, the number-average molecular weight Mn of the sample is derived.

The adhesive component B may be selected, as a single species or a combination of two or more species as desired, from the following materials: polyamide resins, polyester resins, epoxy resins having an extremely high molecular weight, polyurethane resins, acrylic resins (e.g., polymethyl methacrylate, polyacrylamide, etc.), vinyl resins such as polyvinyl pyrrolidone, polyvinyl chloride resins (e.g., vinyl chloride-vinylidene chloride copolymers, vinyl chloride-vinyl acetate copolymers, etc.), cellulose resins (e.g., methyl cellulose, ethyl cellulose, carboxymethyl cellulose, etc.), polyvinyl alcohol resins (e.g., polyvinyl alcohol, partially saponified polyvinyl alcohol, etc.), petroleum resins, rosin derivatives, coumarone-indene resins, terpene resins, novolak-type phenolic resins, polystyrene resins (e.g., styrene-acrylic copolymers, etc.), polyolefin resins (e.g., polyethylene, polypropylene, polybutene, ethylene-vinyl acetate copolymers, etc.), polyvinyl ether resins, polyethylene glycol resins; and elastomers, natural rubbers, styrene-butadiene rubbers, isoprene rubbers, etc.

The adhesive component B may preferably have a softening temperature of 300° C. or below particularly 250° C. or below. The adhesive component B may be in a softened state at room temperature. Further, the adhesive component B has a glass transition temperature (Tg) of 0° C. or below.

Among these materials, a polyurethane resin may preferably be used as the adhesive component B. A polyurethane resin preferably used in the present invention may be obtained by the following polyaddition reaction of a diisocyanate with a glycol:

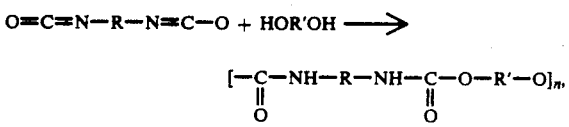

As the polyurethane resin, there are two types, i.e., a polyether-type resin comprising a diisocyanate such as tolylenediisocyanate and methylenediphenyldiisocyanate, and a hydroxy compound such as polyoxypropylene glycol and polyoxypropylenepolyoxyethylene glycol; and a polyester-type resin mainly of a condensation product comprising adipic acid and ethylene glycol. These two types of polyurethans are respectively called polyetherpolyurethane and polyester-polyurethane. Among these polyurethanes, polyester-polyurethane may preferably be used in the thermal transfer material according to the present invention.

It has been known that a polyurethane resin is used as an adhesive material. However, in the adhesive layer of the present invention, an adhesive component is mixed with a wax component preferably comprising a polyethylene wax (particularly an oxidized polyethylene) whereby the adhesion thereof has a characteristic such that it irreversibly decreases through heat-application. The adhesive layer 2 according to the present invention preferably has a softening temperature of 60°-200° C.

The first ink layer 3 comprises a resin, as a binder, and a colorant. The resin used in the first ink layer 3 has a glass transition temperature of 0° C. or below, preferably −10° C. or below, and preferably has a relatively large tensile elongation of 300 % or above, more preferably 500 % or above. In the first ink layer 3, a relatively large amount of a colorant (particularly a pigment) may preferably be added to the binder, whereby the tensile elongation and tensile strength thereof are suppressed.

The tensile elongation used herein is the proportion of a change in length to an original length. The tensile elongation is based on values measured by using a sample in the form of a flat dumbbell having a thickness of 50 μm and a width (a narrow portion) of 6 mm, and using a tensile tester (Tensilon RTM-100, mfd. by Toyo Boldwin K.K.) at a pulling speed of 300 mm/sec at room temperature (25° C.).

In a case where the binder used in the first ink layer 3 has a glass transition temperature of 0° C. or below, the binder is always in the state of a kind of supercooled liquid in the time of printing and storage. As a result, the first ink layer does not show brittleness. Accordingly, the first ink layer 3 is not transferred partially when only the second ink layer 4 is intended to be transferred.

Further, the binder preferably has a relatively large tensile elongation. If the binder has a tensile elongation of below 300 %, there are some cases wherein the first ink layer shows brittleness.

The binder used in the first ink layer 3 which satisfies the above-mentioned conditions may include: acrylate copolymers such as alkyl acrylates copolymers, acrylonitrile-alkyl acrylate copolymers, styrene-alkyl acrylate copolymers, and alkyl methacrylate-alkyl acrylate copolymers; latexes such as styrene-butadiene latexes, nitrile-butadiene latexes, acrylic latexes, and vinyl acetate latexes; urethane resins such as polyester-type urethanes, polyethertype urethanes; etc. These binders may be used singly or as appropriate mixtures. Further, as desired, another binder material such as waxes or resins or another additive may be added to the above-mentioned binders.

In the present invention, the relatively small tensile strength and tensile elongation of the first ink layer 3 may be realized by adding a relatively large amount of a pigment to the above binder.

The pigment content in the first ink layer 3, is generally 25-85 %, preferably 35-70 % based on the weight of the first ink layer, while the pigment content may desirably be optimized by changing it depending on the property of the adhesive layer or the second ink layer.

If the pigment content is below 25 %, the decrease in the tensile strength and tensile elongation of the binder is insufficient. On the other hand, if the pigment content is above 85 %, the first ink layer becomes brittle whereby the separation of colors is insufficient when only the second ink layer is intended to be transferred.

In the present invention, in order to easily control the adhesion, a second adhesive layer 6 may be disposed, as desired, between the first ink layer 3 and second ink layer 4. In such a case, since the adhesion between the first ink layer 3 and the second ink layer 4 is controlled by the second adhesive layer 6, materials constituting the first and second ink layers, or the pigment content of these ink layers may be selected from a wider scope thereof.

The second adhesive layer 6 should preferably be so composed as to provide a softening temperature which is equal to or lower than that of the second ink layer 4. When a recording is conducted by a thermal head, the trailing end portion of the image portion in the moving direction of the thermal head changes from a printing temperature to a nonprinting temperature. However, during this course of cooling, if the second ink layer 4 is attached to a recording medium while the strength of the second adhesive layer 6 is still relatively high, the first ink layer 3 can be transferred along with the second ink layer 4 to unintensionally provide the color of the first ink layer 3. This phenomenon can be prevented by setting the softening temperature of the second adhesive layer 6 to be equal to or lower than that of the second ink layer 4 as described above.

The second adhesive layer 6 may preferably have a softening temperature of 60°-130° C., more preferably 70°-100° C. Further, it is preferred that the second adhesive layer 6 is so composed as to provide a melt viscosity (by a rotary viscometer) in the range of 1 cps to 100,000 cps at a temperature which is 30° C. higher than the softening temperature thereof.

The second ink layer 4 may preferably have a softening temperature of 60°-200° C. more preferably 80°-150° C. Further, a third adhesive layer may be disposed on the second ink layer 4 as desired, in order to improve the transfer characteristics of the ink layer to a recording medium.

In the thermal transfer material of the present invention, the ink layers and the adhesive layer on the support 1 (i.e., layers except the support) may preferably have a thickness of not exceeding 20 μm in total. Further, it is preferred that each of the first ink layer 3, second ink layer 4, first adhesive layer 2 and second adhesive layer 6 has a thickness in the range of 0.1-10 μm.

As the support 1 of the thermal transfer material, it is possible to use films of, e.g., polyester, aramide resin, nylon, polycarbonate, or paper such as capacitor paper, preferably having a thickness of about 2 to 12 μm. Too thick a support is not desirable because the heat conductivity becomes inferior. If a sufficient heat resistance and a strength are attained, a support can be thinner than 2 μm.

The second ink layer 4 and the optional second adhesive layer 6 may comprise a binder as described below, singly or as an appropriate mixture, to which a colorant and another additive may be added as desired.

Examples of such binder may includes: wáxes including: natural waxes such as whale wax, beeswax, lanolin, carnauba wax, candelilla wax, montan wax and ceresin wax; petroleum waxes such as paraffin wax and microcrystalline wax; synthetic waxes such as ester wax, low molecular weight polyethylene, Fischer-Tropsch wax and the like; higher fatty acids such as lauric acid, myristic acid, palmitic acid, stearic acid, and behenic acid; higher alcohols such as stearyl alcohol and behenyl alcohol; esters such as fatty acid esters of sucrose and fatty acid esters of sorbitane; amides such as oleic amide; or thermoplastic resins including: homopolymers of styrene and substituted styrenes such as polystyrene, poly-p-chlorostyrene, and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate, polybutyl methacrylate, polyvinyl chloride, polyvinyl acetate, polyethylene, ethylene-vinyl acetate copolymer, ethylene-acrylic acid copolymer, polypropylene, polyester, polyurethane, polyamide, epoxy resin, polyvinyl butyral, polyacrylic acid resin, rosin, modified rosin, terpene resin, phenolic resin, aliphatic and alicyclic hydrocarbon resins, and aromatic petroleum resin; homopolymers and copolymers of olefin such as polyethylene, polypropylene, polyisobutylene, polyethylene wax, oxidized polyethylene, polytetrafluoroethylene, ethylene-acrylic acid copolymer, ethylene-ethyl acrylate copolymer and ethylene-vinyl acetate copolymer; and derivatives of these polymers.

The colorant used in the first and second ink layers may be selected from all of the known dyes and pigments including: carbon black, Nigrosin dyes, lamp black, Sudan Black SM, Alkali Blue, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 20, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Kataset YG, Smiplast Yellow GG, Zapon Fast Orange RR, Oil Scarlet, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. Two or more of these colorant may be used in combination as desired. Further, metal powder such as copper powder and aluminum powder or powder of mineral such as mica may also be used as a colorant. Further, other additives such as plasticizers, mineral oils, vegetable oils, etc., may also be added.

The second ink layer and the second adhesive layer having the desired properties as descirbed above may be obtained by appropriately controlling the properties such as molecular weights, crystallinities, etc., of the above-mentioned materials or appropriately mixing a plurality of the above mentioned materials.

In order to prepare the thermal transfer material according to the present invention, the materials for the respective layers may be formed into aqueous emulsions by the addition of a dispersant such as a surfactant, and the aqueous emulsions may preferably be applied to form the respective layers. Further, in consideration of the materials constituting the respective layers, these materials may be mixed with an organic solvent such as methyl ethyl ketone, xylene and tetrahydrofuran and the thus formed coating liquids may successively be applied onto the support. Alternatively, the so-called hot-melt coating method may be adopted, including the steps of blending, hot-melting and applying the materials in a molten state for the respective layers. Further, the respective layers of the transfer material may also be formed by using the above-mentioned coating methods in combination, i.e., by using different methods for the respective layers.

In a case where the first adhesive layer 2 comprises a wax component A and an adhesive component B, the particulate wax component may preferably be dispersed in the adhesive component to form a coating mixture, which is then applied to form the first adhesive layer. Alternatively, these components may preferably be formed into aqueous emulsion by the addition of a dispersant such as a surfactant, and the aqueous emulsion may be applied to form the first adhesive layer. Such methods may preferably be adopted in order to fully exhibit the characteristics of the above-mentioned particulate wax component.

Now, a method of recording effected by using the thermal transfer material of the present invention will be explained.

Incidentally, in an embodiment described hereinbelow, a thermal head is used as the most typical heat source, and a thermal transfer material having a structure shown in FIG. 2 and having a characteristic shown in FIG. 3 is used.

Figure 4:
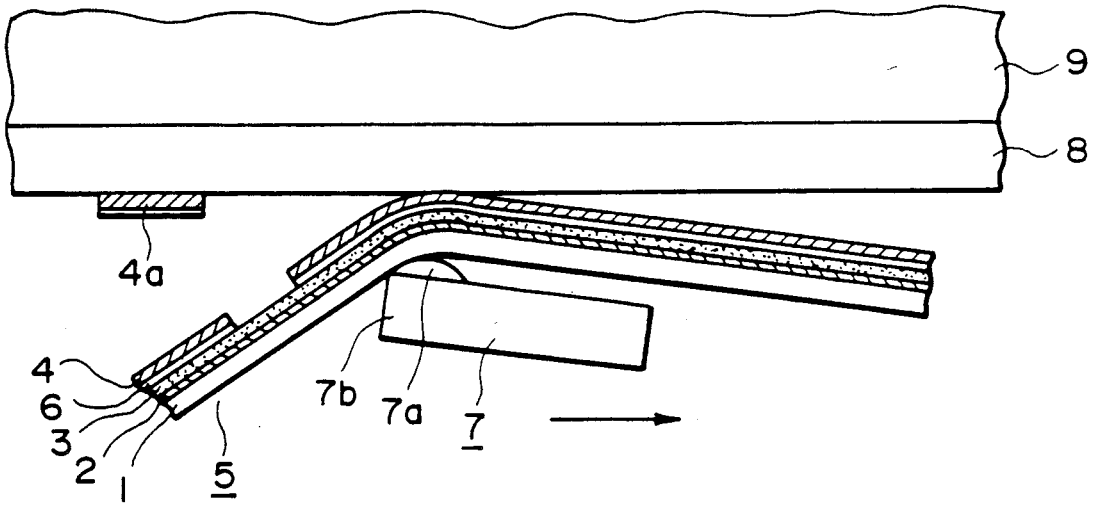
FIG. 4 is a schematic sectional view showing a state of the separation between the thermal transfer material of the present invention and a recording medium immediately after heating.

FIG. 4 is a schematic sectional view taken in the thickness direction of the transfer material for illustrating a mode of operation wherein the second ink layer 4 is selectively transferred. In FIG. 4, reference numeral 5 denotes the thermal transfer material of the present invention, numeral 7 denotes a thermal head, numeral 7a denotes a heat-generating portion of the thermal head, numeral 8 denotes a recording medium such as paper, and numeral 9 denotes a platen.

In this embodiment, the first ink layer 3 is colored in black and the second ink layer 4 is colored in red. FIG. 4 shows a state after recording. The thermal head 7 has passed in the right direction and the transfer material 5 is wound up about a reel (not shown), whereby the transfer material 5 is peeled off from the recording medium 8 just after it has passed through the heater portion 7a of the thermal head 7. The instant immediately after the peeling-off corresponds to the time $t_1$ in FIG. 3. As a result, a red image 4a is obtained on the recording medium 8.

Figure 5:
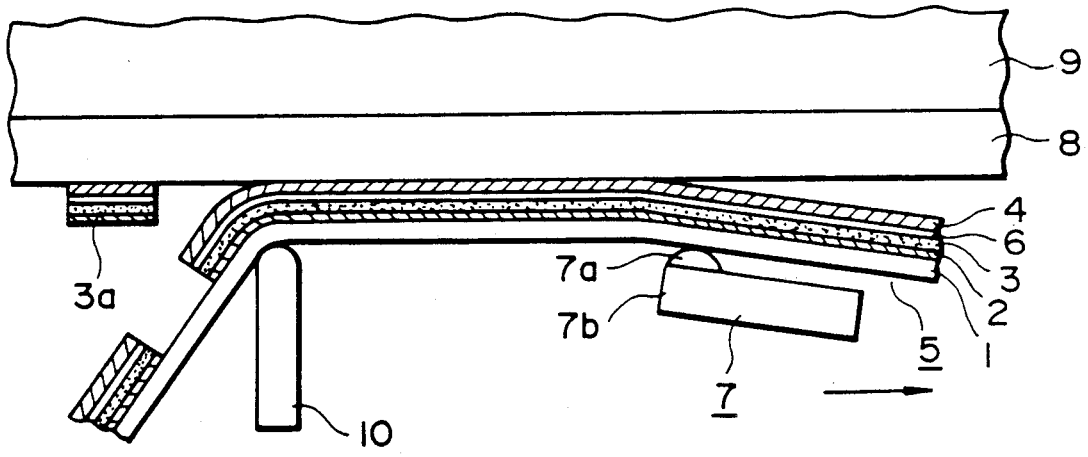
FIG. 5 is a schematic sectional view showing a state of the separation between the thermal transfer material of the present invention and a recording medium after a prescribed time counted from the heating.

FIG. 5 is a schematic sectional view taken in the thickness direction of the transfer material for illustrating a mode of operation wherein both the first ink layer 3 and the second ink layer 4 are transferred. This mode is different from the one explained in FIG. 4 in that the transfer material 5, after heating, runs without additional operation for some length while being in contact with the recording medium 8 by the action of a pressing member 10 and then is peeled off.

The member 10 is, for example, disposed on a carriage (not shown) of a thermal transfer recording apparatus. The member 10 moves in association with the thermal head 7 while retaining a certain distance from the thermal head 7, and can be moved, as desired, toward and away from the transfer material. More specifically, when the member 10 is moved away, the transfer material 5 is peeled off from the recording medium 8, immediately after the thermal head 7 has passed by as shown in FIG. 4. In contrast, when the member 10 is pushed toward the recording medium 8 as shown in FIG. 5, the transfer material 5 is kept in contact with the recording medium 8 for some time after the thermal head 7 has passed by to give a longer period from the time when a heat energy is applied to the transfer material 5 until the time when the transfer material 5 is peeled off.

As described hereinabove, in the thermal transfer material according to the present invention, the adhesion ($F_1$) between the first ink layer 3 and the support 1 decreases to 1.0–10.0 g/cm and becomes smaller than the adhesion ($F_2$) between the first ink layer 3 and the second ink layer 4. As a result, when the thermal transfer material 5 is peeled off from the recording medium 8 immediately after the member 10, both the first ink layer 3 and the second ink layer 4 are transferred to the recording medium 8, whereby a black image 3a is obtained on the recording medium 8.

In the above-mentioned embodiment, a thermal head 7 is exemplified as a heating means. However, a heating means is not restricted to the thermal head, but a light source such as laser beam, etc., may also be used in place of the thermal head. Further, in order to provide a conduction heating system using a recording stylus, i.e., a system wherein a thermal transfer material itself generates a heat due to a current passing therethrough, the support may be formed into a resistance layer and electro-conductive powder may be contained in the ink layer.

Hereinbelow, the present invention will be explained more specifically while referring to specific examples of practice.

EXAMPLE 1

<Ink 1>

| | |
|---|---|
| Oxidized polyethylene wax aqueous dispersion (Mn = 4000, softening temp. = 125° C., particle size = 1 μm) | 70 parts |
| Polyester-polyurethane resin aqueous dispersion (Superflex-300, mfd. by Diichi Kogyo Seiyaku K.K.) | 30 parts |

(The amounts of aqueous dispersions for providing an ink formulation in this example and the other examples are all expressed based on their solid contents.)

The above components were sufficiently mixed to prepare an ink 1. The ink 1 was applied onto a 3.5 μ-thick PET (polyethylene terephthalate) film and dried at 60° C. to form a 0.5 μ-thick first adhesive layer.

<Ink 2>

| | |
|---|---|
| Alkyl acrylates copolymer aqueous dispersion (Acronal YJ-8501D supplied from Mitsubishi Yuka Badische K.K., glass transition temp. Tg = −60° C.) | 70 parts |
| Carbon black aqueous dispersion | 30 parts |

The above components were sufficiently mixed to prepare an ink 2, which was applied onto the above prepared first adhesive layer and dried at 80° C. to form a 2 μm-thick first ink layer.

Then, a paraffin wax (softening temp. =69° C.) aqueous dispersion was applied onto the above prepared first ink layer and dried at 60° C. to form a 1 μm-thick second adhesive layer.

<Ink 3>

| | |
|---|---|
| Oxidized polyethylene wax aqueous dispersion (Mn = 2000, softening temp. = 120° C.) | 65 parts |
| Vinyl acetate-ethylene copolymer aqueous dispersion (ethylene content = 20%, softening temp. = 119° C.) | 35 parts |
| Naphthol AS aqueous dispersion | 30 parts |

Figure 2:
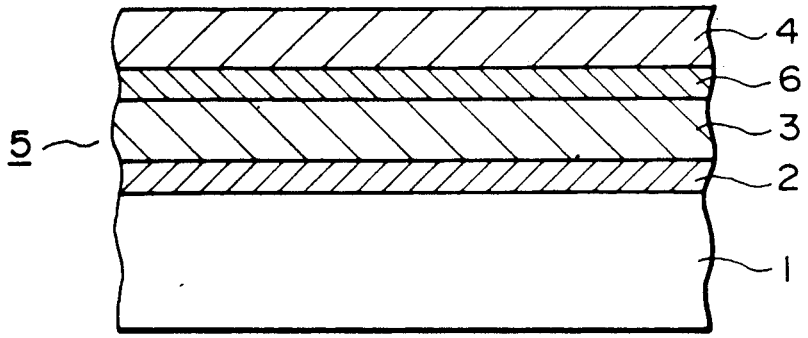

The above components were sufficiently mixed to prepare an ink 3 which was applied onto the above prepared second adhesive layer and dried at 80° C. to form a 2 μm-thick second ink layer, whereby a thermal transfer material (I) as shown in FIG. 2 was obtained.

EXAMPLE 2

A thermal transfer material (II) was prepared in the same manner as in Example 1 except that a second adhesive layer was not formed.

EXAMPLE 3

<Ink 4>

| | |
|---|---|
| Oxidized polyethylene wax aqueous dispersion (Mn = 4000, softening temp. = 125° C., particle size = 1 μm) | 80 parts |
| Polyester-polyurethane resin aqueous dispersion (Superflex-100, mfd. by Daiichi Kogyo Seiyaku K.K.) | 20 parts |

The above components were sufficiently mixed to prepare an ink 4.

A thermal transfer material (III) was prepared in the same manner as in Example 1 except that the above ink 4 was used to form a first adhesive layer instead of the ink 1 used for the first adhesive layer of the thermal transfer material (I).

EXAMPLE 4

<Ink 5>

| | |
|---|---|
| Oxidized polyethylene wax aqueous dispersion (Mn = 4000, softening temp. = 125° C., particle size = 1 μm) | 65 parts |
| Polyester-polyurethane resin aqueous dispersion (Superflex-200, mfd. by Daiichi Kogyo Seiyaku K.K.) | 35 parts |

The above components were sufficiently mixed to prepare an ink 5.

A thermal transfer material (IV) was prepared in the same manner as in Example 1 except that the above ink 5 was used to form a first adhesive layer instead of the ink 1 used for the first adhesive layer of the thermal transfer material (I).

EXAMPLE 5

<Ink 6>

| | |
|---|---|
| Oxidized polyethylene wax aqueous dispersion (Mn = 4000, softening temp. = 125° C., particle size = 1 μm) | 75 parts |
| Polyester-polyurethane resin aqueous dispersion (Impranil DLN, mfd. by Bayer) | 25 parts |

The above components were sufficiently mixed an ink 6.

A thermal transfer material (V) was prepared in the same manner as in Example 1 except that the above ink 6 was used to form a first adhesive layer instead of the ink 1 used for the first adhesive layer of the thermal transfer material (I).

EXAMPLE 6

<Ink 7>

| | |
|---|---|
| Oxidized polyethylene wax aqueous dispersion (Mn = 4000, softening temp. = 125° C., particle size = 1 μm) | 40 parts |
| Polyester-polyurethane resin aqueous dispersion (Superflex-300, mfd. by Daiichi Kogyo Seiyaku K.K.) | 60 parts |

The above components were sufficiently mixed to prepare an ink 7.

A thermal transfer material (VI) was prepared in the same manner as in Example 1 except that the above ink 7 was used to form a first adhesive layer instead of the ink 1 used for the first adhesive layer of the thermal transfer material (I).

EXAMPLE 7

<Ink 8>

| | |
|---|---|
| Oxidized polyethylene wax aqueous dispersion (Mn = 4000, softening temp. = 125° C., particle size = 1 μm) | 95 parts |
| Polyester-polyurethane resin aqueous dispersion (Superflex-300, mfd. by Daiichi Kogyo Seiyaku K.K.) | 5 parts |

The above components were sufficiently mixed to prepare an ink 8.

A thermal transfer material (VII) was prepared in the same manner as in Example 1 except that the above ink 8 was used to form a first adhesive layer instead of the ink 1 used for the first adhesive layer of the thermal transfer material (I).

EXAMPLE 8

<Ink 9>

| | |
|---|---|
| Latex aqueous dispersion (Nipol LX-814 mfd. by Nippon Zeon K.K., minimum film-forming temp.: below 0° C.) | 60 parts |
| Carbon black aqueous dispersion | 40 parts |

The above components were sufficiently mixed to prepare an ink 9.

A thermal transfer material (VIII) was prepared in the same manner as in EXample 1 except that the above ink 9 was used to form a first ink layer instead of the ink 2 used for the first ink layer of the thermal transfer material (I).

COMPARATIVE EXAMPLE 1

<Ink 10>

| | |
|---|---|
| Oxidized polyethylene wax aqueous dispersion (Mn = 4000, softening temp. = 125° C., particle size = 1 μm) | 80 parts |
| Alkyl acrylates copolymer aqueous dispersion (Acronal YJ-8501D, supplied from Mitsubishi Yuka Badische K.K., Tg = −60° C.) | 20 parts |

The above components were sufficiently mixed to prepare an ink 10.

A thermal transfer material (IX) was prepared in the same manner as in Example 1 except that the above ink 10 was used to form a first adhesive layer instead of the ink 1 used for the first adhesive layer of the thermal transfer material (I).

COMPARATIVE EXAMPLE 2

<Ink 11>

| | |
|---|---|
| Oxidized polyethylene wax aqueous dispersion (Mn = 4000, softening temp. = 125° C., particle size = 1 μm) | 80 parts |
| Polyamide resin aqueous dispersion (Macromelt 6301, mfd. by Henkel Kakusui K.K., softening point (measured by a ring and ball method) = 90° C.) | 20 parts |

The above components were sufficiently mixed to prepare an ink 11.

A thermal transfer material (X) was prepared in the same manner as in Example 1 except that the above ink 11 was used to form a first adhesive layer instead of the ink 1 used for the first adhesive layer of the thermal transfer material (I).

COMPARATIVE EXAMPLE 3

<Ink 12>

| | |
|---|---|
| Oxidized polyethylene wax aqueous dispersion (Mn = 4000, softening temp. = 125° C., particle size = 1 μm) | 60 parts |
| Styrene-acrylic copolymer resin aqueous dispersion (Tg = 15° C., minimum film-forming temp. = 17° C.) | 40 parts |

The above components were sufficiently mixed to prepare an ink 12.

A thermal transfer material (XI) was prepared in the same manner as in Example 1 except that the above ink 12 was used to form a first adhesive layer instead of the ink 1 used for the first adhesive layer of the thermal transfer material (I).

COMPARATIVE EXAMPLE 4

<Ink 13>

| | |
|---|---|
| Oxidized polyethylene wax aqueous dispersion (Mn = 4000, softening temp. = 125° C., particle size = 1 μm) | 30 parts |
| Polyester-polyurethane resin aqueous dispersion (Superflex-300, mfd. by Daiichi Kogyo Seiyaku K.K.) | 70 parts |

The above components were sufficiently mixed to prepare an ink 13.

A thermal transfer material (XII) was prepared in the same manner as in Example 1 except that the above ink 13 was used to form a first adhesive layer instead of the ink 1 used for the first adhesive layer of the thermal transfer material (I).

COMPARATIVE EXAMPLE 5

<Ink 14>

| | |
|---|---|
| Oxidized polyethylene wax aqueous dispersion (Mn = 4000, softening temp. = 125° C., particle size = 1 μm) | 97 parts |
| Polyester-polyurethane resin aqueous dispersion (softening temp. = 220° C.) | 3 parts |

The above components were sufficiently mixed to prepare an ink 14.

A thermal transfer material (XIII) was prepared in the same manner as in Example 1 except that the above ink 14 was used to form a first adhesive layer instead of the ink 1 used for the first adhesive layer of the thermal transfer material (I).

Then, the above prepared thermal transfer materials (I) to (XIII) were respectively used for recording by means of two kinds of thermal transfer printers (trial products) respectively using different kinds of thermal heads. More specifically, as the thermal head 7, one having a pixel density of 160 dots/inch and one having a heating element density of 240 dots/inch, both prepared by Rohm K.K., were respectively used. Further, a printing energy of 28 mJ/mm$^2$ was used.

Both of these thermal heads had a length from the center of the heat generating part 7*a* to the trailing end 7*b* (as shown in FIG. 4) of 350 μm. A carriage (not shown) loading the thermal head 7 and thermal transfer material 5 was moved at a moving velocity of 50 mm/sec. As a result, the time from heating until the peeling-off of the thermal transfer material 5 from a recording medium 8 was about 7 msec (corresponding to the time $t_1$ in FIG. 3) in the rapid peeling-off mode. In order to delay the time of the peeling, a pressing member 10 for controlling the peeling was disposed at about 5 mm after the trailing end 7*b* of the thermal head 7 (i.e , downstream side of the trailing end 7*b* with respect to the moving direction of the thermal transfer material 5).

As a result, when the pressing member 10 was moved toward the recording medium 8, the delayed time of peeling-off was about 100 msec (corresponding to the time $t_2$ in FIG. 3) after the heating.

While the thermal transfer materials (I)—(XIII) were respectively used for recording in this manner, the adhesion $F_1$ after heat-application in these thermal transfer materials (I)–(XIII) were measured according to the above-mentioned first measurement method. These results are shown in Table 1 described below.

TABLE 1

| | Transfer material | Results of recording 160 dot/inch | Results of recording 240 dot/inch | Adhesion $F_1$ (g/cm) after heat-application |
|---|---|---|---|---|
| Example | I | ◎ | ◎ | 3.5 |
| | II | ◎ | ◎ | 3.5 |
| | III | ◎ | ◎ | 4.0 |
| | IV | ◎ | ◎ | 5.0 |
| | V | ◎ | ◎ | 3.0 |
| | VI | Ⓐ | Ⓐ | 9.0 |
| | VII | Ⓑ | Ⓑ | 1.3 |
| | VIII | | | 3.0 |
| Comparative Example | IX | ◎ | $X_1$ | 0.5 |
| | X | $X_1$ | $X_1$ | 0.05 |
| | XI | $X_2$ | $X_2$ | 50.0 |
| | XII | $X_2$ | $X_2$ | 25.0 |
| | XIII | ◎ | $X_1$ | 0.5 |

In the above Table 1, the symbols have the following meaning:

O : the printed image was clear;

A : the printed image was somewhat thin but good enough for a practical purpose;

B : the printed image was somewhat lacking in clearness but good enough for a practical purpose;

$X_1$: the printed image was lacking in clearness; and $X_2$: the printed image was poor in transferability and was partially lacking.

Incidentally, the results of recording in Table 1 show those in a case where both the first and second ink layers were transferred (i.e., with respect to black images). On the other hand, in a case where the second ink layer was selectively transferred (i.e., with respect to red images), clear images were obtained by using the thermal transfer materials (I)-(XIII) except for using the thermal transfer material (II) of Example 2. The red image provided by the thermal transfer material (II) was good enough for a practical purpose while a black color was slightly mixed therein Further, it was confirmed that the result of the recording was not substantially different from the case of the position of 5 mm, even if the position of the pressing member 10 was changed in the range of from 2 mm to 20 mm after the trailing end *7b* of the thermal head 7.

Figure 6:
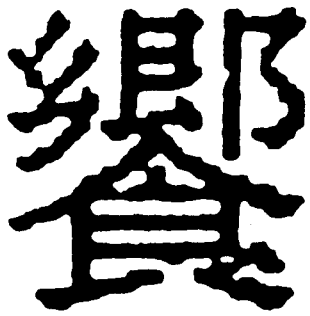
FIG. 6 is an enlarged photograph showing a transferred image provided by the thermal transfer material (I) of Example 1 described hereinafter.
Figure 7:
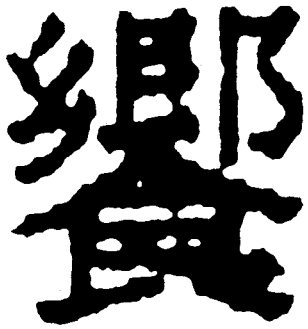
FIG. 7 is an enlarged photograph showing a transferred image provided by the thermal transfer material (IX) of Comparative Example 1 described hereinafter.

Incidentally, an enlarged photograph of the black image obtained in the above-mentioned manner by using the thermal transfer material (I) is shown in FIG. 6. Further, an enlarged photograph of the black image obtained in the above-mentioned manner by using the thermal transfer material (IX) is shown in FIG. 7. The recording conditions used in these cases were as follows:

heating element density of the thermal head: 240 dots/inch,
energy for recording: 28 mJ/mm$^2$, and
recording speed: 2 msec/dot.

As described hereinabove, in the thermal transfer material according to the present invention, an adhesive layer 2 is disposed between a support 1 and a first ink layer 3, and the adhesion ($F_1$) between the support 1 and the first ink layer 3 becomes 1.0–10.0 g/cm after heat-application. As a result, the thermal transfer material according to the present invention provides a clear two-color image excellent in edge-cutting and transferability.

Further, since the thermal transfer material of the present invention provides an image excellent in edge-cutting, the edge portion of the obtained image is closely attacked to a recording medium. As a result, the obtained image is also excellent in wear-resistance.

What is claimed is:

1. A thermal transfer material comprising:

a support and an adhesive layer, a first ink layer and a second ink layer disposed in this order on the support wherein the adhesion strength $F_1$ between the support and the first ink layer and the adhesion strength $F_2$ between the first and second ink layers satisfy the relations of $F_1 > F_2$ at a higher temperature and $F_1 < F_2$ at a lower temperature; said adhesion strength $F_1$ being in the range of 1.0 g/cm–10 g/cm when the relation of $F_1 < F_2$ is satisfied after heating, said adhesive layer comprising a wax component A and an adhesive component B; the weight proportion (A/B) of said wax component A to said adhesive component B satisfying $1 \leqq A/B \leqq 9$, wherein the adhesive component B comprises a polyurethane resin obtained by a polyaddition reaction of a diisocyanate with a glycol.

2. A thermal transfer material according to claim 1, wherein the weight proportion (A/B) of the wax component A to the adhesive component B satisfies a relation of $1.5 \leqq A/B \leqq 6$.

3. A thermal transfer material according to claim 2, wherein the wax component A comprises a polyethylene wax having a softening temperature of 80°–150° C. and a number-average molecular weight of 1,000–6,000.

4. A thermal transfer material according to claim 3 wherein the wax component A comprises a polyethylene wax having a softening temperature of 90°–140° C. and a number-average molecular weight of 2,000–5,000.

5. A thermal transfer material according to claim 1, wherein the wax component A comprises an oxidized polyethylene wax having a softening temperature of 90°–140° C. and a number-average molecular weight of 2,000–5,000.

6. A thermal transfer material according to claim 1, wherein the adhesive component B comprises polyester-polyurethane.

7. A thermal transfer material according to claim 1, wherein the first ink layer comprises a binder of a resin having a glass transition temperature of −10° C. or below.

8. A thermal transfer material according to claim 7, wherein the first ink layer contains 25 wt. -85 wt % thereof of a pigment.

9. A thermal transfer material according to claim 8, wherein the first ink layer contains 35–70 wt. % thereof of a pigment.

10. A thermal transfer material according to claim 1, which further comprises a second adhesive layer between the first and second ink layers.

* * * * *

UNITED STATES PATENT AND TRADEMARK OFFICE

CERTIFICATE OF CORRECTION

PATENT NO. : 5,002,819

DATED : March 26, 1991

INVENTOR(S) : KOICHI TOHMA, ET AL.

It is certified that error appears in the above-identified patent and that said Letters Patent is hereby corrected as shown below:

COLUMN 2

Line 30, "Ser. No." should read --No.--.
Line 55, "Pat. Application Ser. No. 4,980,324" should read --Pat. No. 4,880,324--.
Line 59, "Appli-" should be deleted.
Line 60, "cation Ser. No." should read --No.--.

COLUMN 3

Line 1, "U.S. Pat, Application Ser." should read --U.S. Pat.--.

COLUMN 4

Line 55, Close up right margin.
Line 56, Close up left margin.

COLUMN 6

Line 36, "layer" should read --layer.--.

COLUMN 9

Line 49, "polyurethans" should read --polyurethanes--.
Line 50, "polyetherpolyurethane" should read --polyether-polyurethane--.

UNITED STATES PATENT AND TRADEMARK OFFICE

CERTIFICATE OF CORRECTION

PATENT NO. : 5,002,819

DATED : March 26, 1991

INVENTOR(S) : KOICHI TOHMA, ET AL.

It is certified that error appears in the above-identified patent and that said Letters Patent is hereby corrected as shown below:

COLUMN 11

Line 4, "unintensionally" should read --unintentionally--.
Line 42, "includes:" should read --include:--.

COLUMN 12

Line 33, "colorant" should read --colorants--.
Line 40, "descirbed" should read --described--.

COLUMN 16

Line 45, "EXample 1" should read --Example 1--.

COLUMN 18

TABLE 1, "VIII 3.0" should read --VIII ◎ ◎ 3.0--.
Line 59, "○ :" should read -- ◎ :--.
Line 60, "A :" should read -- Ⓐ :--.
Line 62, "B :" should read -- Ⓑ :--.

COLUMN 19

Line 9, "therein" should read --therein.--.
Line 39, "attacked" should read --attached--.

UNITED STATES PATENT AND TRADEMARK OFFICE

CERTIFICATE OF CORRECTION

PATENT NO. : 5,002,819

DATED : March 26, 1991

INVENTOR(S) : KOICHI TOHMA, ET AL.

It is certified that error appears in the above-identified patent and that said Letters Patent is hereby corrected as shown below:

COLUMN 20

Line 17, "claim 2," should read --claim 1,--.
Line 21, "claim 3" should read --claim 3,--.

Signed and Sealed this

First Day of December, 1992

*Attest:*

DOUGLAS B. COMER

*Attesting Officer*

*Acting Commissioner of Patents and Trademarks*